US006308620B1

(12) United States Patent
Wadlinger et al.

(10) Patent No.: US 6,308,620 B1
(45) **Date of Patent: *Oct. 30, 2001**

(54) PRINTING PRESS HAVING A MULTIPLY-POSITIONED AND MULTI-FUNCTIONED SHEET GUIDING CYLINDER

(75) Inventors: Ralf Wadlinger, Ludwigshafen; Rudolf Leib; Günter Stephan, both of Wiesloch, all of (DE)

(73) Assignee: Heidelberger Druckmaschinen, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/075,794

(22) Filed: May 11, 1998

(30) Foreign Application Priority Data

May 9, 1997 (DE) ..... 197 19 624

(51) Int. Cl.[7] ..... B41F 5/16; B41F 5/18; B41F 21/00; B41F 13/24; B05C 11/00

(52) U.S. Cl. ..... 101/183; 101/232; 101/246; 118/46; 118/224; 118/249

(58) Field of Search ..... 101/183, 232, 101/416.1, 419, 420, 421, 424.1, 409, 246, 184, 479, 485; 271/3.21, 3.22; 118/46, 224, 249, 262

(56) References Cited

U.S. PATENT DOCUMENTS

| | | | | |
|---|---|---|---|---|
| 3,190,218 | * | 6/1965 | Willard | 101/184 |
| 3,461,798 | * | 8/1969 | Bulk et al. | 101/184 |
| 3,926,118 | * | 12/1975 | Preuss | 101/246 |
| 4,280,406 | * | 7/1981 | Corse | 101/246 |
| 4,365,553 | * | 12/1982 | Fischer et al. | 101/232 |
| 4,395,949 | * | 8/1983 | Jeschke | 101/420 |
| 4,493,255 | * | 1/1985 | Fischer | 101/183 |
| 4,552,069 | * | 11/1985 | Jahn | 101/420 |
| 4,688,784 | * | 8/1987 | Wirz | 271/195 |
| 4,766,809 | * | 8/1988 | Giori et al. | 101/152 |
| 4,779,557 | * | 10/1988 | Frazzitta | 118/46 |
| 4,794,856 | * | 1/1989 | Giori | 101/152 |
| 4,836,103 | * | 6/1989 | Komori et al. | 101/231 |
| 4,905,595 | * | 3/1990 | Jeschke | 101/246 |
| 4,973,040 | * | 11/1990 | Kemp et al. | 271/277 |
| 5,007,339 | * | 4/1991 | Germann | 101/177 |
| 5,009,156 | * | 4/1991 | Germann | 101/177 |
| 5,072,671 | * | 12/1991 | Schneider et al. | 101/467 |
| 5,088,404 | | 2/1992 | MacConnell et al. | 101/232 |
| 5,115,740 | * | 5/1992 | Emrich et al. | 101/412 O |
| 5,178,678 | * | 1/1993 | Koehler et al. | 101/177 |
| 5,272,975 | * | 12/1993 | Dettinger et al. | 101/218 |
| 5,456,178 | * | 10/1995 | Henn et al. | 101/407.1 |
| 5,555,804 | * | 9/1996 | Kojima | 101/183 |
| 5,564,692 | * | 10/1996 | Lotsch et al. | 271/195 |
| 5,678,486 | * | 10/1997 | Bachmeir et al. | 101/246 |
| 5,836,247 | * | 11/1998 | Stephan et al. | 101/420 |
| 5,927,203 | * | 7/1999 | Gieser et al. | 101/419 |

FOREIGN PATENT DOCUMENTS

| | | | | |
|---|---|---|---|---|
| 4318777C2 | | 4/1996 | (DE) . | |
| 806874 | * | 12/1936 | (FR) | 101/416.1 |

* cited by examiner

*Primary Examiner*—Kimberly L. Asher
(74) *Attorney, Agent, or Firm*—Herbert L. Lerner; Laurence A. Greenberg; Werner H. Stemer

(57) ABSTRACT

A sheet-fed rotary printing press having at least one unit including an impression cylinder and an additional cylinder assigned to the impression cylinder, the impression cylinder and the additional cylinder being relatively adjustable a spaced distance from one another, includes a sheet guiding device disposed on the additional cylinder for keeping sheets of printing material, which have been transported by the impression cylinder past the additional cylinder, away from the additional cylinder, once the spaced distance between the impression cylinder and the additional cylinder has been set.

22 Claims, 7 Drawing Sheets

PRINTING PRESS HAVING A MULTIPLY-POSITIONED AND MULTI-FUNCTIONED SHEET GUIDING CYLINDER

BACKGROUND OF THE INVENTION

Field of the Invention

The invention relates to a sheet-fed rotary printing press having at least one unit which includes an impression cylinder and an additional cylinder assigned to the impression cylinder, the impression cylinder and the additional cylinder being relatively adjustable a spaced distance from one another.

In multicolor sheet-fed rotary printing presses, downline from which a varnishing unit is disposed, the transported sheets are printed with ink only in the initial printing units during the printing operation. Downline printing and varnishing units, respectively, are in an idling mode wherein the rubber blanket cylinder and the varnish blanket cylinder, respectively, are disengaged from the printing cylinder. A small gap is formed therebetween, through which the previously printed sheets are transported. Because of the high press speed, the sheets lift away from the respective printing cylinder, so that the freshly applied ink comes into contact with the rubber blanket or varnish blanket and smears.

The published German Patent Document DE 43 18 777 C2 shows a printing unit of a sheet-fed rotary printing press, wherein devices for aiding or promoting sheet guidance are provided, in order to avoid, respectively, smearing of and damage to the freshly printed image. The provisions taken in the heretofore known devices, however, are not always effective because, for example, in a rear region of the sheet, contact of the sheet end with the rubber blanket or the varnish blanket cylinder occurs, nevertheless, when the printing is performed on stiff sheet material.

SUMMARY OF THE INVENTION

Departing from the aforementioned prior state of the art, it is an object of the invention of the instant application to provide a sheet-fed rotary printing press which enables smear-free sheet travel when the printing, varnishing or finishing units are shut down.

With the foregoing and other objects in view, there is provided, in accordance with the invention, a sheet-fed rotary printing press having at least one unit including an impression cylinder and an additional cylinder assigned to the impression cylinder, the impression cylinder and the additional cylinder being relatively adjustable a spaced distance from one another, comprising a sheet guiding device disposed on the additional cylinder for keeping sheets of printing material, which have been transported by the impression cylinder past the additional cylinder, away from the additional cylinder, once the spaced distance between the impression cylinder and the additional cylinder has been set.

In accordance with another feature of the invention, the additional cylinder is stoppable, so that it will not rotate while the impression cylinder rotates.

In accordance with a further feature of the invention, the sheet-fed rotary printing press includes a clutch via which the additional cylinder is decouplable from a printing-press drive for driving the additional cylinder.

In accordance with an added feature of the invention, the additional cylinder is formed with a cylinder gap approximately alignable with the impression cylinder in a stopped condition of the additional cylinder, for setting the spaced distance between the additional cylinder and the impression cylinder.

In accordance with an additional feature of the invention, the sheet-fed rotary printing press includes a detent for fixing the additional cylinder relative to a printing-press frame, in a position of the additional cylinder wherein the cylinder gap formed therein is in alignment with the impression cylinder, and in a condition wherein the additional cylinder is decoupled from a printing-press drive for driving the additional cylinder.

In accordance with an alternative feature of the invention, the sheet-fed rotary printing press includes a blast air connection for fixing the additional cylinder relative to a printing-press frame, in a position of the additional cylinder wherein the cylinder gap formed therein is in alignment with the impression cylinder, and in a condition wherein the additional cylinder is decoupled from a printing-press drive for driving the additional cylinder.

In accordance with yet another feature of the invention, the sheet guiding device includes at least one sheet guiding element secured to the additional cylinder.

In accordance with yet a further feature of the invention, the sheet guiding element is formed as at least one guide tongue.

In accordance with an alternative feature of the invention, the sheet guiding element is formed as at least one small wheel.

In accordance with another alternative feature of the invention, the sheet guiding element is formed as at least one blast tube.

In accordance with yet a further feature of the invention, the blast tube is couplable to a blast air connection at an end face of the additional cylinder.

In accordance with yet an added feature of the invention, the additional cylinder is formed with a cylinder gap, and the sheet guiding element being received in the cylinder gap.

In accordance with yet an additional feature of the invention, at least one cylinder of the impression cylinder and the additional cylinder is constructed so as to be engageable with and disengageable from the other for setting the spaced distance between the impression cylinder and the additional cylinder.

In accordance with still another feature of the invention, the sheet-fed rotary printing press includes a cylinder liner on the additional cylinder, the cylinder liner being removable from the additional cylinder for setting the spaced distance between the impression cylinder and the additional cylinder.

In accordance with still a further feature of the invention, the impression cylinder and the additional cylinder, between which the spaced distance is set, are rotatable in common with one another, while the sheet guiding device acts upon the sheet to be printed.

In accordance with still an added feature of the invention, the sheet guiding device comprises blast air nozzles disposed on the circumferential surface of the additional cylinder.

In accordance with still an additional feature of the invention, the additional cylinder has a stationary cylinder core formed with a chamber chargeable with blast air, and an outer casing rotatable about the stationary cylinder core, the outer casing having blast air ducts leading to the blast air nozzles.

In accordance with another feature of the invention, the sheet-fed rotary printing press includes a rotary valve assigned to the additional cylinder and, upon rotation of the additional cylinder, intermittently subjecting the rotating blast air nozzles to blast air whenever the blast air nozzles are directed generally towards the impression cylinder.

In accordance with a further feature of the invention, the at least one unit is a printing unit, and the additional cylinder is a cylinder for printing on the sheet to be printed.

In accordance with an alternative feature of the invention, the at least one unit is a varnishing unit, and the additional cylinder is a cylinder for varnishing the sheet to be printed.

In accordance with another alternative feature of the invention, the at least one unit is a finishing unit, and the additional cylinder is a processing cylinder having a circumference occupied by tools for processing the sheet to be printed.

In accordance with a concomitant feature of the invention, the at least one unit is disposed downline from at least one printing unit of the sheet-fed rotary printing press, as viewed in a sheet transport direction therethrough.

Preferably, the sheet guiding device forces the sheet to be printed approximately in the direction of the impression cylinder.

Other features which are considered as characteristic for the invention are set forth in the appended claims.

Although the invention is illustrated and described herein as embodied in a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 8 is a greatly diagrammatic, side elevational view, in profile, of a full sheet-fed rotary printing machine of which FIG. 1 is only a fragment.

DESCRIPTION OF THE PREFERRED EMBODIMENTS

Figure 1:
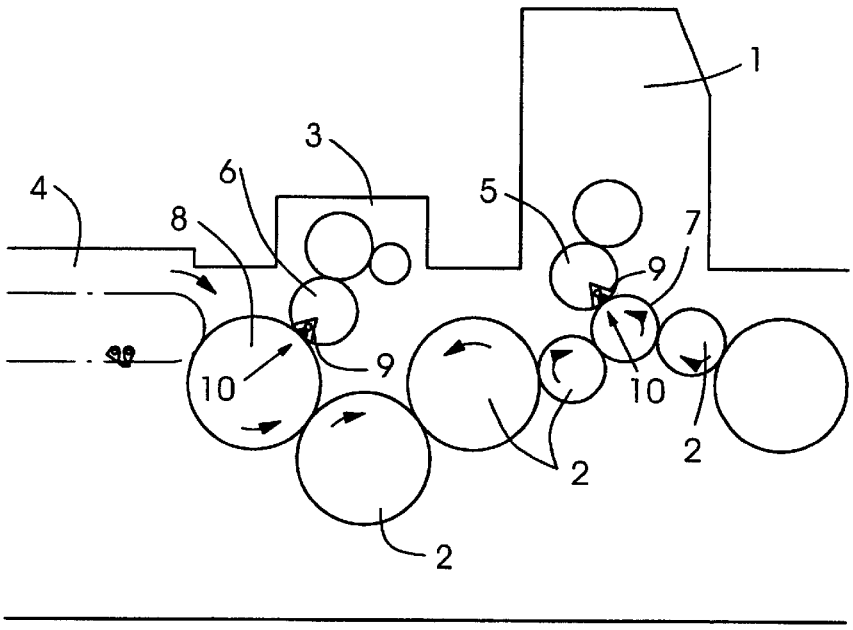
FIG. 1 is a fragmentary diagrammatic side elevational view of a sheet-fed rotary printing press wherein printing and varnishing units have been shut down or stopped.
Figure 3:
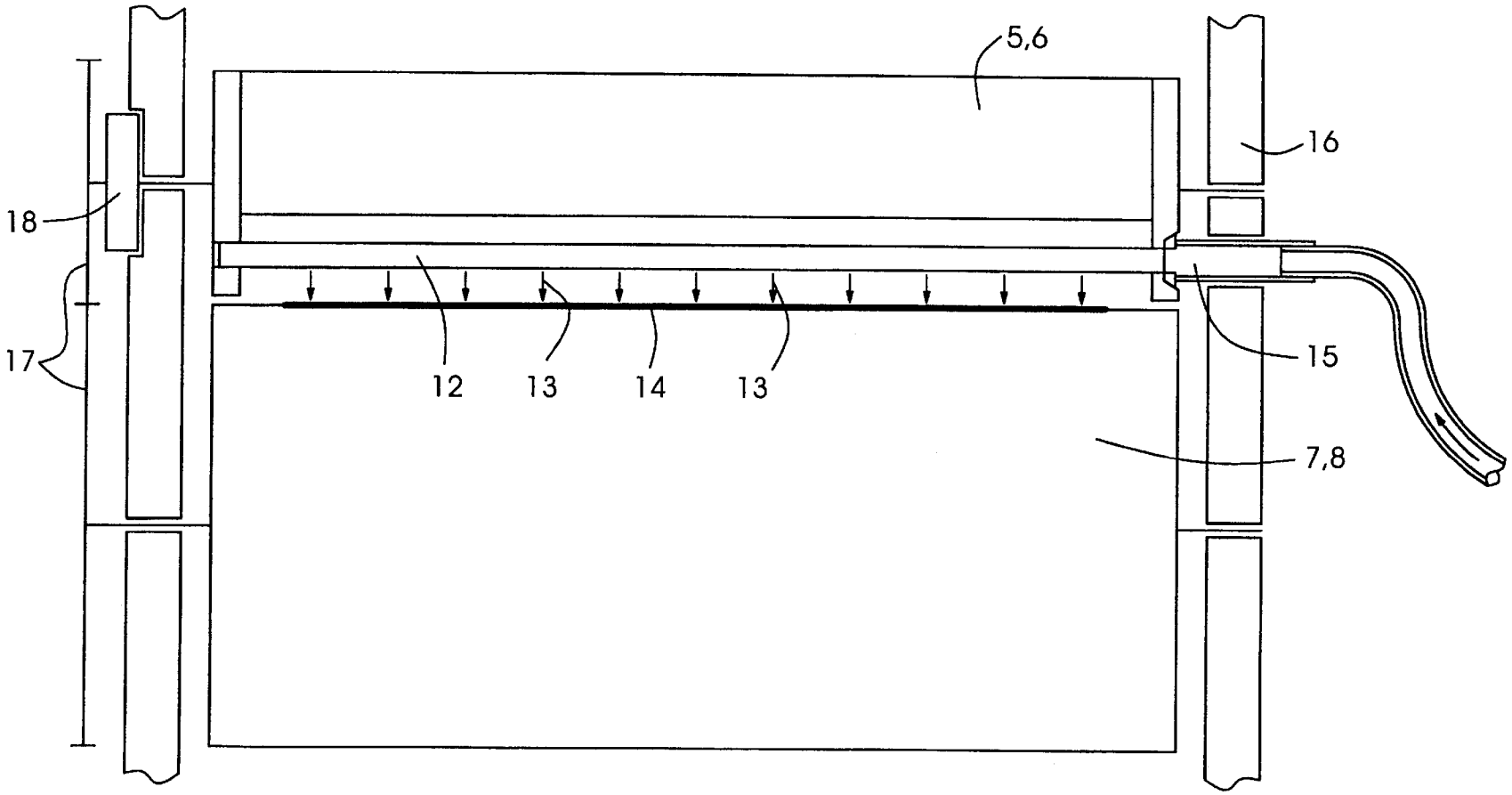
FIG. 3 is a much reduced side elevational view of FIG. 2 as seen from the right-hand side thereof and showing the sheet guiding device extending longitudinally through the cylinder gap.

Referring now to the drawings and, first, particularly to FIG. 1 thereof, there is shown therein a sheet-fed rotary printing press having a rubber blanket cylinder 5 and a varnish blanket cylinder 6 separated from a press drive mechanism 17 by a clutch 18 (FIG. 3, for example). The cylinders 5 and 6, respectively, are formed with cylinder gaps 9 oriented opposite to respective impression cylinders 7 and 8, the rubber blanket cylinder 5 and the varnish blanket cylinder 6 being fixed in this position. Sheet guiding elements 10 are provided in the cylinder gaps 9. With this construction according to the invention, in the region of the cylinder gap 9, the spacing or spaced distance to the jacket surface of the respective printing cylinders 7 and 8 is increased, so that a considerably greater clearance or interspace is provided for transporting the sheets. By disposing the sheet guiding elements 10 in the cylinder gaps 9, smear-free transport of the sheets can be improved further yet so that even the ends of the sheets cannot become smeared. With this construction in accordance with the invention, the spacing between the two cylinders of the prior art device is increased many times.

Figure 8:
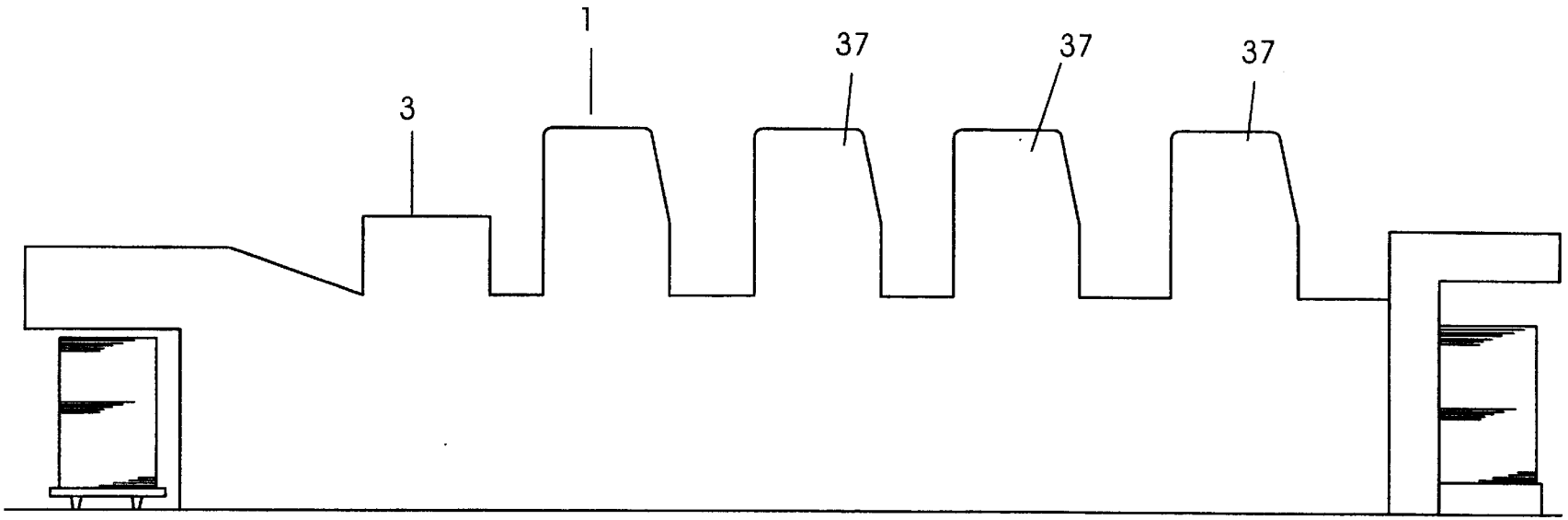

FIG. 1 illustrates part of a multicolor sheet-fed rotary printing press, wherein sheets, which have already been printed by printing units 37, as shown in FIG. 8, are then fed to a printing unit 1 which does not take part in the printing of the sheets. The printed sheets are transported from the printing unit 1 by transfer drums 2 through a varnishing unit 3, which also does not take part in the printing of the sheets, and are then fed to a sheet delivery 4. The rubber blanket cylinder 5 and the varnish blanket cylinder 6 are disengaged from the respective printing cylinders 7 and 8. The rubber blanket cylinder 5 and the varnish blanket cylinder 6 are formed with respective cylinder gaps 9, wherein suitable blanket fasteners are provided in a conventional manner.

In the cylinder gaps 9 of the rubber blanket cylinder 5 and the varnish blanket cylinder 6, there are provided sheet guiding elements 10 which may be embodied as guide baffles or guide tongues 11. The guide baffles/guide tongues 11 can be inserted into the cylinder gaps 9 and fastened or otherwise secured therein. Consequently, when stiff cardboard is printed, for example, the rear or trailing edge of the cardboard sheet can slide along the guide baffles/guide tongues 11 without damaging the imprint.

An advantageous construction in accordance with the invention is that of embodying the sheet guide elements 10 as blast or blow tubes 12, which are couplable to blown or blast air connections on an end face of the respective cylinder 5, 6. The blow tubes 12 can thus emit a vertical air flow or current onto the sheets to be transported, thereby achieving maximum contact pressure. The blast air 13 of the blow tubes 12 is directed vertically towards the sheets transported by the respective impression cylinders 7 and 8, so that the sheets are pressed down onto the respective impression cylinders 7 and 8 without coming into contact with any parts of the rubber blanket cylinder 5 or varnish blanket cylinder 6. By the mere use of these blast or blow tubes 12 alone, respective smearing and lifting away of the printed sheets is prevented. The guide tongues 11 may be provided in addition to the blast air 13 and the blast or blow tube 12, respectively, so that even when cardboard is being processed, smearing of the printed image is avoided. The spacing between the guide tongues 11 and the jacket surface of the respective impression cylinder 7, 8 is increased considerably, which again aids in or supports the smear-free transport of the sheets.

Figure 4:
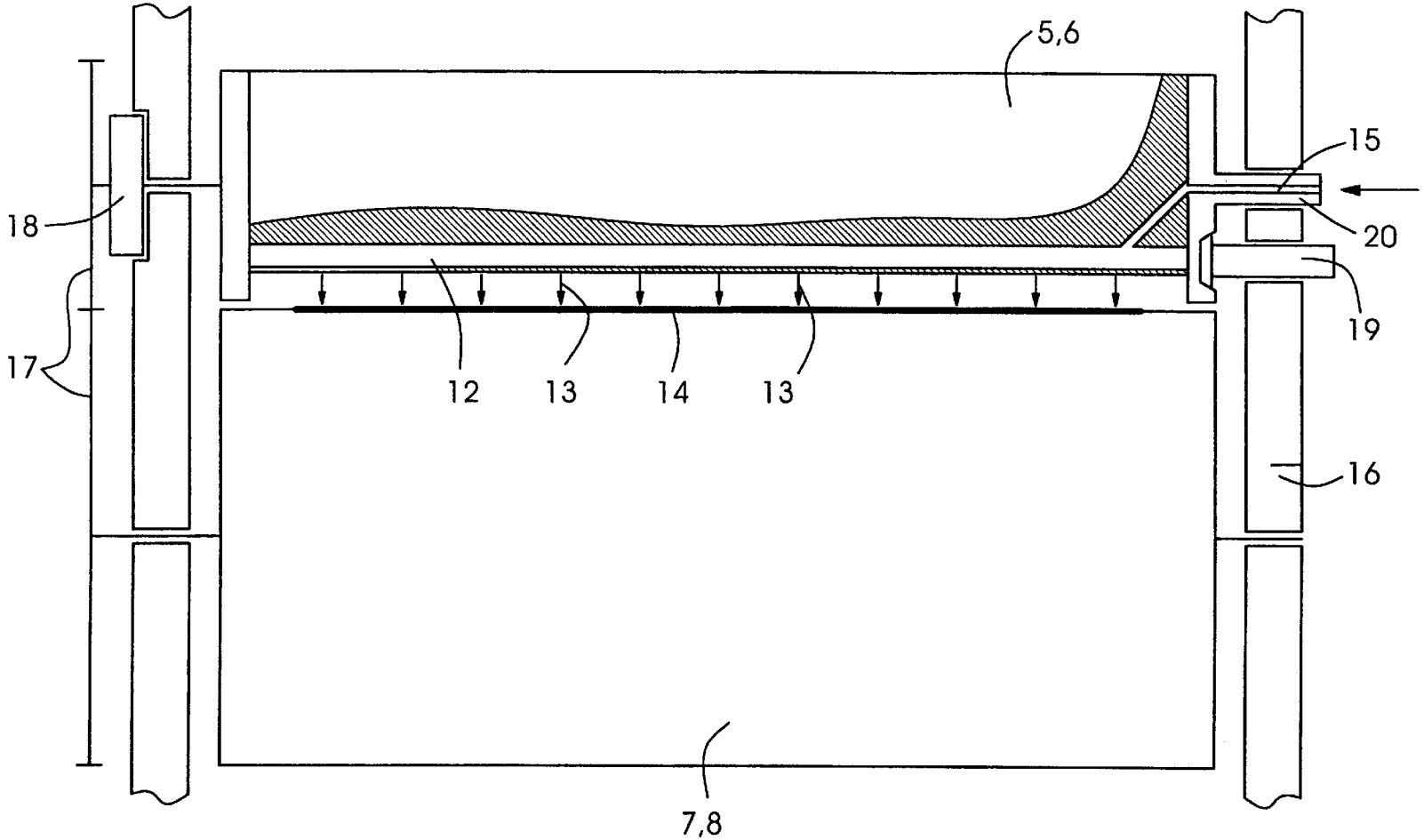
FIG. 4 is a view like that of FIG. 3 of another embodiment of the invention, showing one of the cylinders partly in section and provided with an integral blow tube.

The device shown in FIG. 3 includes the feature of the rubber blanket cylinder 5 and the varnishing blanket cylinder 6, in the decoupled condition thereof, being fixable relative to a press side frame 16 via blast or blown air connections 15 and detents 19. By the insertion of the blast or blown air connections 15, the cylinders can be fixed in position via a seal. Independently thereof, the detents 19 shown in FIG. 4 can also be used, the detents 19 locking into place in the stopped cylinder and assuring the fixation thereof.

FIG. 3 is a longitudinal view of the blow tube 12, showing a printed sheet 14 being transported on the jacket surface of the respective impression cylinder 7, 8 and being held down by blast or blown air 13 emerging from the blast or blow tube 12. The latter is supported in the rubber blanket cylinder 5 and varnish blanket cylinder 6, respectively, and is couplable to the end face of the cylinder with a blast or blown air connection 15. By inserting the blast or blown air connection 15, the rubber blanket cylinder 5 and the varnish blanket cylinder 6, respectively, are fixable in the decoupled position thereof relative to a press side frame 16. Alternatively, a detent 19 (FIG. 4) may be provided for fixation purposes between the respective rubber blanket cylinder 5 and varnish blanket cylinder 6, on the one hand, and the press side frame 16, on the other hand. The blast air connection 15 may also be provided in a trunnion or axle journal 20 so that the blast air can be fed to the blow tube 12 inside the cylinder 5, 6.

Figure 2:
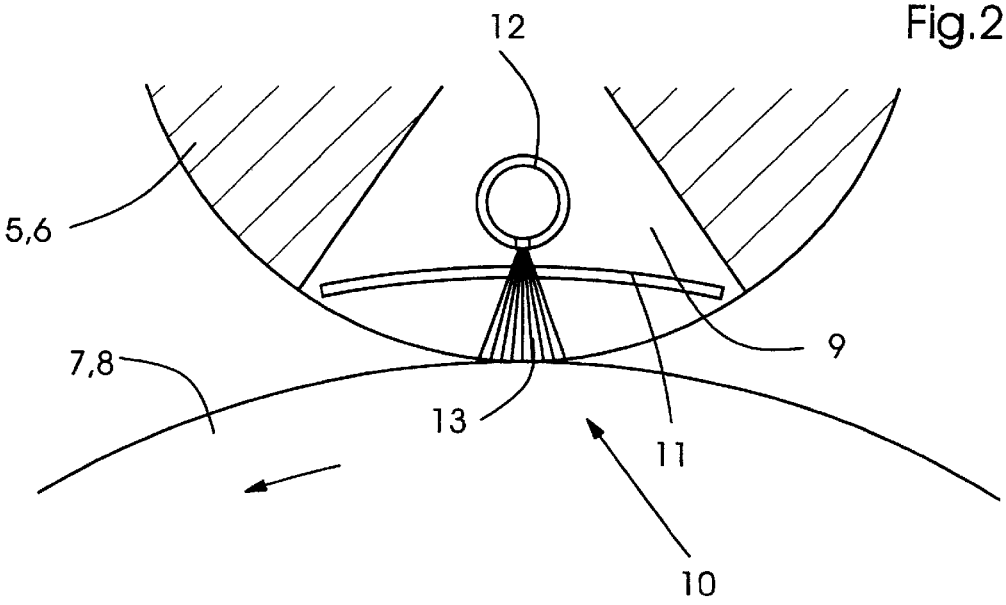
FIG. 2 is an enlarged fragmentary cross-sectional view of FIG. 1 showing one of the cylinders of the press formed with a cylinder gap having a sheet guiding element disposed therein.

Both the rubber blanket cylinder 5 and the varnish blanket cylinder 6 are disconnectable or separable from the printing-press drive 17 via a respective clutch 18, so that the cylinder gaps 9 are directed towards the respective printing cylinder 7, 8, as shown in FIG. 1 and FIG. 2, for example. The rubber blanket cylinder 5 and the varnish blanket cylinder 6 are fixed in this position, so that the printing press can continue production with the upline printing units thereof without hindrance.

Figure 5:
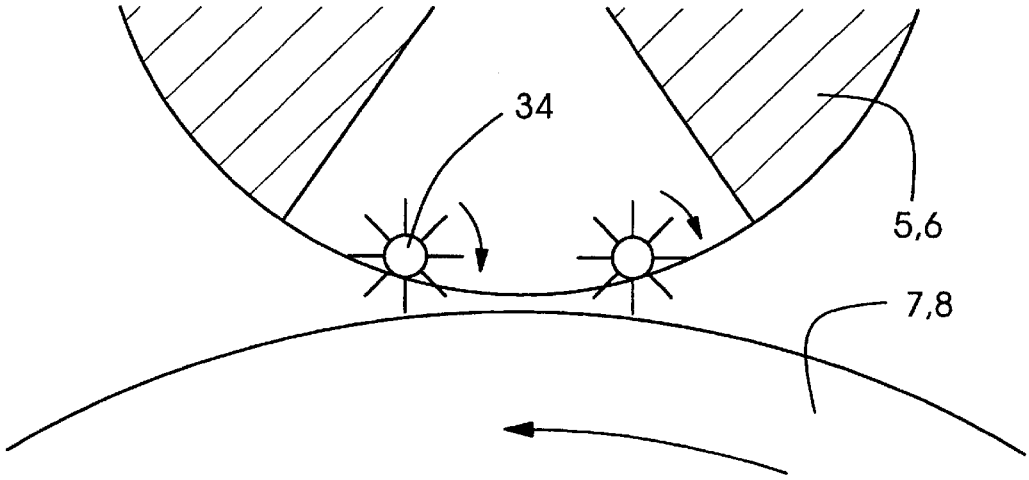
FIG. 5 is a view like that of FIG. 2 of a further embodiment of the invention which has a different sheet guiding device.

FIG. 5 shows a modification of the embodiment of the invention illustrated in FIG. 2. In addition to or in combination with the sheet guiding element 10 shown in FIG. 2, small wheels 34 formed as tail wheels are rotatably secured to the cylinder 5, 6. The small wheels 34 are adjustable in the axial direction of the cylinder 5, 6 and can preferably be set on elongated corridors of the sheet 14 that are free of any printed image. The wheels 34 can also roll off in the region of the printed image, virtually precluding any smearing of the fresh printing ink. For one, the wheels 34 can be rotated by the printed sheets 14 in contact therewith, so that no relative motion, which leads to smearing, can take place between the printed sheets 14 and the wheels 34. For another, the wheels 34 with their needlelike points have only minimal point contact with the printed sheets 14.

Figure 6:
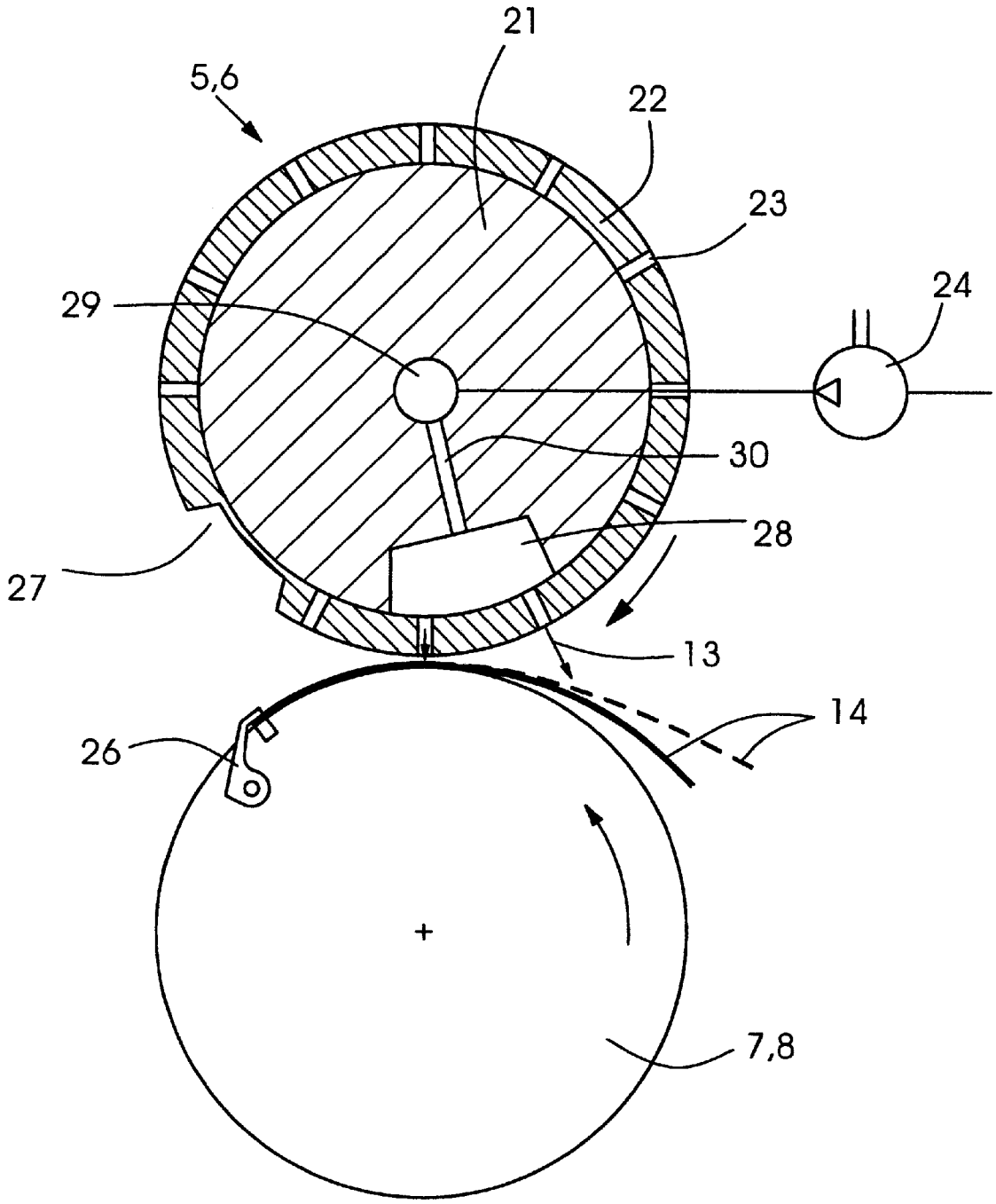
FIG. 6 is an enlarged fragmentary cross-sectional view of FIG. 1 of an added embodiment of the invention.

In FIG. 6, a further embodiment of the invention is illustrated which differs from the embodiments described in conjunction with the preceding figures of the drawings in that the additional cylinder 5, 6 is not shut down or stopped, but rather, rotates as well while the sheet 14 to be printed is fed past the additional cylinder 5, 6 by the respective impression cylinder 7, 8. An advantage derived therefrom is that relative motion between the circumferential surface of the additional cylinder 5, 6 and the sheet 14 to be printed is avoided, thereby avoiding smearing. This is important, for example, in the event that the blast or blown air nozzles 35, which force away the sheet 14 to be printed from the additional cylinder 5, 6, have not yet been activated, or that the blast or blown air pressure is set too low. The additional cylinder 5, 6, in the embodiment shown in FIG. 6, is constructed as a varnishing blanket or rubber blanket cylinder, just as in the preceding figures of the drawings described hereinabove. The spacing between the circumferential surfaces of the additional cylinder 5, 6, on the one hand, and the impression cylinder 7, 8, or the sheet 14 to be printed, which rests on the impression cylinder 7, 8, on the other hand, can be established or set by shifting the additional cylinder 5, 6 away from the impression cylinder 7, 8. The spacing can also be set or established by removing from the additional cylinder 5, 6, a cylinder liner 36 (note FIG. 7), for example, a rubber blanket, which is required on the additional cylinder 5, 6 for the active use thereof, for example, for printing or varnishing, thereby also exposing the blast or blown air openings 35. As shown in FIG. 6, the blast or blown air openings 35 can be distributed uniformly in the circumferential and axial directions over the entire jacket surface of the additional cylinder 5, 6, and arranged in rows. The additional cylinder 5, 6 is of multipartite construction, a cylinder core 21 thereof being formed with a chamber 28, which is open on the outside thereof facing towards a casing 22. The chamber 28 can be supplied with compressed air from a blast or blown air source 24 via a central channel 29 and one or more radial channels 30. The chamber 28 may be an axially parallel channel extending over the entire length of the cylinder. The hollow-cylindrical casing 22 rotates about the cylinder core 21 and, as a result thereof, blown or blast air ducts 23 which terminate in the blast or blown air nozzles 35 (FIG. 7) intermittently coincide, on the inside, with the chamber 28, so that the blast or blown air can pass from the chamber 28 into the blast or blown air ducts 23 and can flow out of the respective blast or blown air nozzles 35 rotating past the chamber 28 at the time. The cylinder core 21 may be adjustable in the circumferential direction, so that the location of the chamber 28 is variable. For example, the chamber 28 can be adjusted so that it is aligned precisely with the center of the impression cylinder 7, 8 or somewhat in the direction of the entry or infeed gap where the sheet 14 to be printed enters between the cylinder 5, 6, on the one hand, and the cylinder 7, 8, on the other hand. Sheet guiding elements for keeping the sheet 14 to be printed mechanically spaced apart from the additional cylinder 5, 6, namely, for example, the guide tongues 11 or small wheels 34 shown in the figures of the drawings described hereinabove, are suitable particularly for heavy, stiff cardboard. Pneumatically acting sheet guiding devices, such as the blast or blow tube 12 and the blast or blown air nozzles 35 shown in FIG. 7, are especially well suited for lightweight papers.

Figure 7:
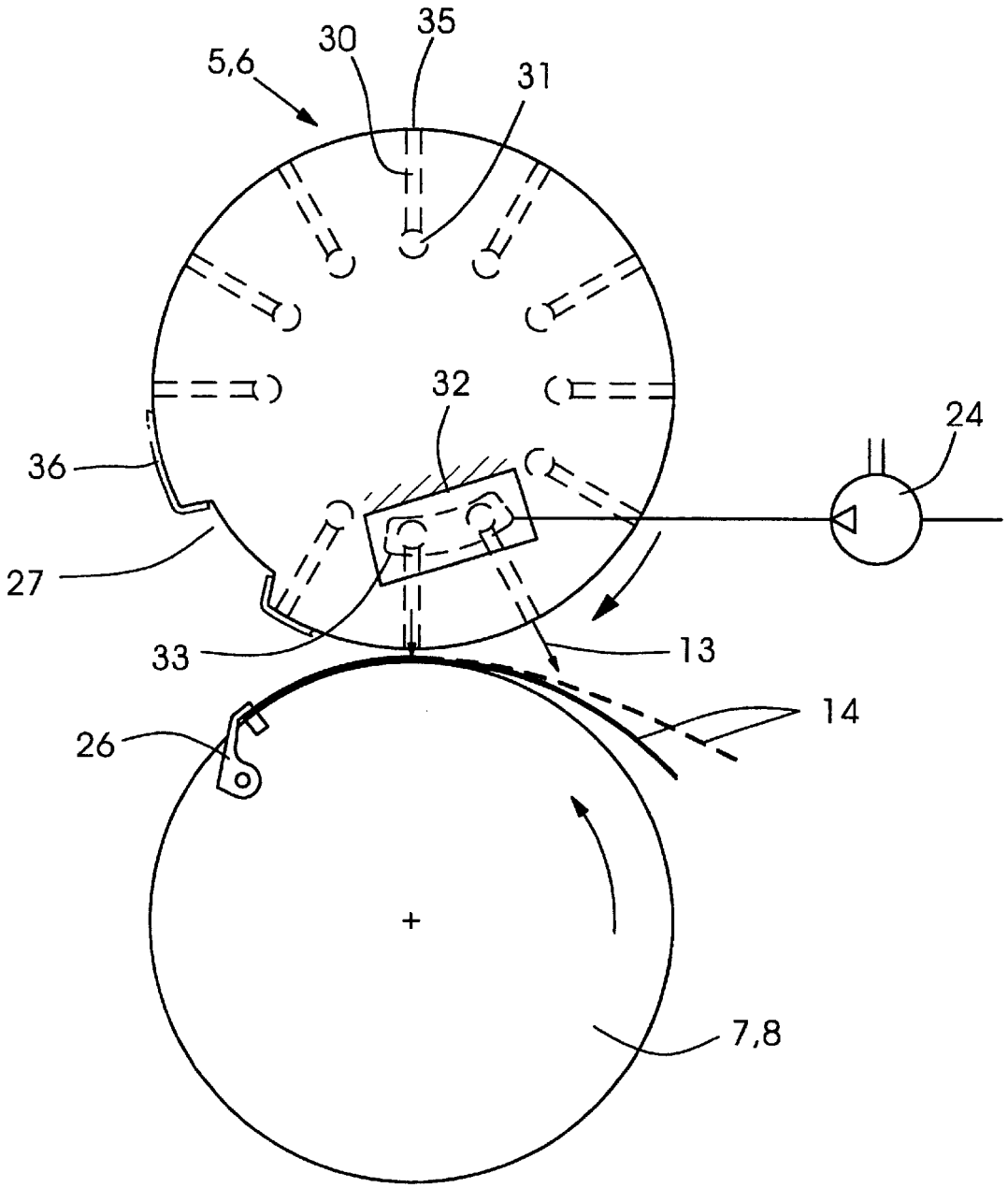
FIG. 7 is a view similar to that of FIG. 6 of an additional embodiment of the invention.

A further embodiment of the invention shown in FIG. 7 is a modification of the embodiment shown in FIG. 6. The additional cylinder 5, 6 is of unipartite construction in this embodiment and is formed with longitudinal channels 31 extending in an axially parallel direction, and radial channels 30 terminating in the blast or blown air nozzles 35 branch off from the longitudinal channels 31. The longitudinal channels 31 terminate at the end face of the cylinder. Upon rotation of the additional cylinder 5, 6, the longitudinal channel openings 31 intermittently coincide with a valve opening 33 of a rotary valve 32 disposed externally to the cylinder, for example, on the press side frame. The valve opening 33 facing towards the longitudinal channel openings 31 on the additional cylinder 5, 6 is part of a chamber of the rotary valve 32 that is acted upon by blown or blast air from the blown or blast air source 24. The blown or blast air emerges from the valve opening 33 and enters into the longitudinal channel opening 31 whenever or as long as the openings 31 and 33 coincide with one another. The openings 31 formed in the cylinder, and the opening 33 located externally to the cylinder are disposed so that, substantially in the region of the nip formed by the cylinder 5, 6, on the one hand, and the cylinder 7, 8, on the other hand, the blast or blown air nozzles 35 moving past are acted upon by blast or blown air, as has been described hereinbefore in conjunction with FIG. 6. In this manner, the sheet 14 to be printed, which is being conveyed by the impression cylinder 7, 8, is kept spaced apart from the additional cylinder 5, 6.

In FIG. 8, the printing press previously shown in part in FIG. 1 is shown again, printing units 37 disposed upline or upstream from the printing unit 1 and the varnishing unit 3, as viewed in the sheet transport direction, being also shown therein. Instead of or in addition to the varnishing unit 3, a finishing unit may be provided, which likewise has an impression cylinder 7, 8, however, this cylinder does not cooperate with a coating cylinder 5, 6 as in the case of the printing or varnishing units 1, 3, but rather with a processing cylinder. The processing cylinder, installed, for example, in place of the rubber blanket or varnishing blanket cylinder 5, 6, is furnished with tools. For example, a plate with stamping tools can be deployed on the processing cylinder. The processing cylinder may also be equipped on the circumference thereof with embossing, fluting or perforating tools, in order to permit finishing of the printed product after the printing has been performed by the printing units 37.

What is claimed is:

1. A sheet-fed rotary printing press comprising:

at least one upstream printing unit:

a plurality of sheet-processing units downstream of said at least one upstream printing unit, each said sheet-processing unit including a blanket cylinder and an impression cylinder:

each said sheet-processing unit having a first mode of operation and a second mode of operation, the mode of operation of each said sheet-processing unit being selected by an operator of the printing press;

said first mode of operation of each said sheet-processing unit comprising an inactive mode where said blanket cylinder is in a fixed and non-rotating position spaced away from said impression cylinder;

said second mode of operation of each said sheet-processing unit comprising an active mode where said blanket cylinder is in rotating contact with said impression cylinder and forms a sheet-processing nip therewith;

each said blanket cylinder of each said sheet-processing unit having a gap formed in the outer peripheral surface of said blanket cylinder, said gap housing a sheet-guiding assembly;

said sheet-guiding assembly of each said blanket cylinder comprising an air blowing structure;

in said first inactive mode of operation, each said blanket cylinder of said sheet-processing units, in said fixed and non-rotating spaced away position, has said gap and said sheet-guiding assembly pointed towards said impression cylinder of said sheet-processing units;

wherein, a freshly printed sheet from said at least one upstream printing unit transported by said impression cylinder of said sheet-processing unit in said first inactive mode, does not contact said blanket cylinder of said sheet-processing unit due to the air being blown thereon by said sheet-guiding assembly of said blanket cylinder; and in said second active mode of operation, said blanket cylinder of said sheet-processing units being in rotating contact with said impression cylinder of said sheet-processing units, and forming said sheet-processing nip therewith;

wherein a freshly printed sheet transported by said impression cylinder of said sheet-processing unit in said second active mode from said at least one upstream printing unit is processed in said sheet-processing nip by one of an additional printing of said freshly printed sheet, varnishing of said freshly printed sheet, or finishing of said freshly printed sheet.

2. A sheet-fed rotary printing press, comprising:

at least one upstream printing unit and at least one sheet processing unit downstream of said at least one upstream printing unit;

said at least one sheet processing unit including an impression cylinder, an additional cylinder and a sheet guiding device, said additional cylinder being a cylinder selected from the group consisting of a coating cylinder, a printing cylinder, a varnishing cylinder, and a finishing cylinder;

at least one of said impression cylinder and said additional cylinder being configured for providing a setting of a spaced distance between said impression cylinder and said additional cylinder;

said sheet guiding device being disposed on said additional cylinder;

said at least one sheet processing unit having a first mode of operation and a second mode of operation, one of said modes of operation being selected by an operator of the printing press;

said additional cylinder being used in each of said modes of operation;

in said first mode of operation said additional cylinder being in rotational contact with a first sheet freshly printed in said at least one upstream printing unit and transported by said impression cylinder, and forming together with said impression cylinder a sheet processing nip;

in said first mode of operation the first sheet being processed in the sheet processing nip by one of a coating of the first sheet, printing of the first sheet, varnishing of the first sheet or finishing of the first sheet;

in said second mode of operation said additional cylinder being used for guiding a second sheet freshly printed in said at least one upstream printing unit by said sheet guiding device; and in said second mode of operation the second sheet being transported by said impression cylinder past said additional cylinder and, simultaneously, said sheet guiding device keeping the second sheet away from said additional cylinder.

3. The sheet-fed rotary printing press according to claim 2, wherein said additional cylinder is in a stopped state when the spaced distance between said impression cylinder and said additional cylinder is set and said impression cylinder is rotating.

4. The sheet-fed rotary printing press according to claim 3, including a clutch via which the additional cylinder is decouplable from a printing-press drive for driving the additional cylinder.

5. The sheet-fed rotary printing press according to claim 3, wherein said additional cylinder is formed with a cylinder gap approximately aligned with said impression cylinder in the stopped state of said additional cylinder, for setting the spaced distance between said additional cylinder and said impression cylinder.

6. The sheet-fed rotary printing press according to claim 5, including a detent for fixing the additional cylinder relative to a printing-press frame, in a position of the additional cylinder wherein the cylinder gap formed therein is in alignment with the impression cylinder, and in a condition wherein the additional cylinder is decoupled from a printing-press drive for driving the additional cylinder.

7. The sheet-fed rotary printing press according to claim 5, including a blast air connection for fixing the additional cylinder relative to a printing-press frame, in a position of the additional cylinder wherein the cylinder gap formed therein is in alignment with the impression cylinder, and in a condition wherein the additional cylinder is decoupled from a printing-press drive for driving the additional cylinder.

8. The sheet-fed rotary printing press according to claim 2, wherein said sheet guiding device includes at least one sheet guiding element secured to said additional cylinder.

9. The sheet-fed rotary printing press according to claim 8, wherein said sheet guiding element is formed as at least one guide tongue.

10. The sheet-fed rotary printing press according to claim 8, wherein said sheet guiding element is formed as at least one small wheel.

11. The sheet-fed rotary printing press according to claim 8, wherein said sheet guiding element is formed as at least one blast tube.

12. The sheet-fed rotary printing press according to claim 11, wherein said blast tube is couplable to a blast air connection at an end face of the additional cylinder.

13. The sheet-fed rotary printing press according to claim 8, wherein the additional cylinder is formed with a cylinder gap, and wherein said sheet guiding element is received in said cylinder gap.

14. The sheet-fed rotary printing press according to claim 2, wherein at least one cylinder of said impression cylinder and said additional cylinder is constructed so as to be engageable with and disengageable from the other for setting the spaced distance between said impression cylinder and said additional cylinder.

15. The sheet-fed rotary printing press according to claim 2, including a cylinder liner on said additional cylinder, and wherein said cylinder liner is removable from said additional cylinder for setting the spaced distance between said impression cylinder and said additional cylinder.

16. The sheet-fed rotary printing press according to claim 2, wherein said impression cylinder and said additional cylinder, between which the spaced distance is set, are rotatable in common with one another, while said sheet guiding device acts upon the second sheet.

17. The sheet-fed rotary printing press according to claim 16, wherein said sheet guiding device includes blast air nozzles disposed on a circumferential surface of said additional cylinder.

18. The sheet-fed rotary printing press according to claim 17, wherein the additional cylinder has a stationary cylinder core formed with a chamber chargeable with blast air, and an outer casing rotatable about said stationary cylinder core, said outer casing having blast air ducts leading to said blast air nozzles.

19. The sheet-fed rotary printing press according to claim 17, including a rotary valve assigned to the additional cylinder and, upon rotation of the additional cylinder, intermittently subjecting said rotating blast air nozzles to blast air whenever said blast air nozzles are directed generally towards the impression cylinder.

20. The sheet-fed rotary printing press according to claim 2, wherein said at least one sheet processing unit is a printing unit, and said additional cylinder is said printing cylinder.

21. The sheet-fed rotary printing press according to claim 2, wherein said at least one sheet processing unit is a varnishing unit, and said additional cylinder is said varnishing cylinder.

22. The sheet-fed rotary printing press according to claim 2, wherein said at least one sheet processing unit is a finishing unit, and said additional cylinder is a processing cylinder having a circumference occupied by tools.

* * * * *